US010953309B2

(12) United States Patent
Pflum et al.

(10) Patent No.: US 10,953,309 B2
(45) Date of Patent: Mar. 23, 2021

(54) SKATEBOARD COVER

(71) Applicants: Patricia A. Pflum, Red Bank, NJ (US); Francis A. Pflum, Jr., Red Bank, NJ (US); Francis John Pflum, Red Bank, NJ (US)

(72) Inventors: Patricia A. Pflum, Red Bank, NJ (US); Francis A. Pflum, Jr., Red Bank, NJ (US); Francis John Pflum, Red Bank, NJ (US)

( * ) Notice: Subject to any disclaimer, the term of this patent is extended or adjusted under 35 U.S.C. 154(b) by 0 days.

(21) Appl. No.: 16/678,430

(22) Filed: Nov. 8, 2019

(65) Prior Publication Data

US 2020/0147475 A1 May 14, 2020

Related U.S. Application Data

(60) Provisional application No. 62/757,228, filed on Nov. 8, 2018.

(51) Int. Cl.
*A63C 17/00* (2006.01)
*A63C 17/01* (2006.01)

(52) U.S. Cl.
CPC ..... *A63C 17/002* (2013.01); *A63C 17/01* (2013.01)

(58) Field of Classification Search
CPC .... B32B 3/04; A63C 1/02; A63C 1/00; A63C 1/015; A63C 1/014; A63C 1/017; A63C 1/0073
See application file for complete search history.

(56) References Cited

U.S. PATENT DOCUMENTS 4,182,520 A * 1/1980 Stevenson ..... A63C 17/01 280/87.042
4,586,451 A * 5/1986 Mori ..... B63B 59/02 114/219
D643,493 S * 8/2011 Nickolaisen ..... D21/771
2008/0020166 A1* 1/2008 Esposito ..... A63C 5/003 428/41.7
2011/0076437 A1* 3/2011 McKee ..... B32B 25/045 428/68
2011/0236607 A1* 9/2011 Woncik ..... A63C 17/0093 428/12

* cited by examiner

*Primary Examiner* — James A Shriver, II
*Assistant Examiner* — James J Triggs
(74) *Attorney, Agent, or Firm* — Keith D. Nowak; Carter Ledyard & Milburn, LLP

(57) ABSTRACT

A removeable cover for a skateboard and a method for covering a skateboard. A removeable cover is securely affixed to a board including a stretchable top piece, a first side piece and a second side piece, wherein the first and the second side pieces are rigid or semi-rigid. A method for covering a board with a removable cover, the steps including placing a top piece on a top of a deck of a board, placing a first side piece around a side of the deck of the board, stretching the top piece across the deck of the board, and affixing a second side piece to an opposite side of the deck.

4 Claims, 4 Drawing Sheets

SKATEBOARD COVER

This application claims priority to U.S. Provisional Patent Application No. 62/757,228 filed Nov. 8, 2019, entitled "SKATEBOARD COVER" and is hereby incorporated by reference in its entirety.

This invention relates to a cover for a skateboard to change the surface of a skateboard either permanently or temporarily.

BACKGROUND OF THE INVENTION

Skateboards have become more than commonplace in everyday life. Riders use them for transportation as well as sport and exercise. Oftentimes people have multiple skateboards for different reasons or purposes. The reason may be cosmetic or functional. Cosmetic changes include a color or design, and functional differences may include a different board surface to make it easier to ride or perform differently.

SUMMARY OF THE INVENTION

The present invention provides a cover to be applied to the upper surface of a skateboard and secured to that surface to prevent it from moving in order to change the board, cosmetically or functionally. The use of the cover can also extend the lifespan of the skateboard deck. The present invention can be either permanent or temporary. The type of element to secure the cover to the skateboard is variable.

The present invention provides a removeable cover securely affixed to a board including a stretchable top piece, a first side piece and a second side piece, wherein the first and the second side pieces are rigid or semi-rigid.

The present invention provides a method for covering a board with a removable cover, the steps include placing a top piece on a top of a deck of a board, placing a first side piece around a side of the deck of the board, stretching the top piece across the deck of the board, and affixing a second side piece to an opposite side of the deck.

BRIEF DESCRIPTION OF THE DRAWINGS

Further objects, features, and advantages of the invention will become apparent from the following detailed description taken in conjunction with the accompanying figures showing illustrative embodiments of the invention, in which.

DETAILED DESCRIPTION OF THE INVENTION

Figure 1A:
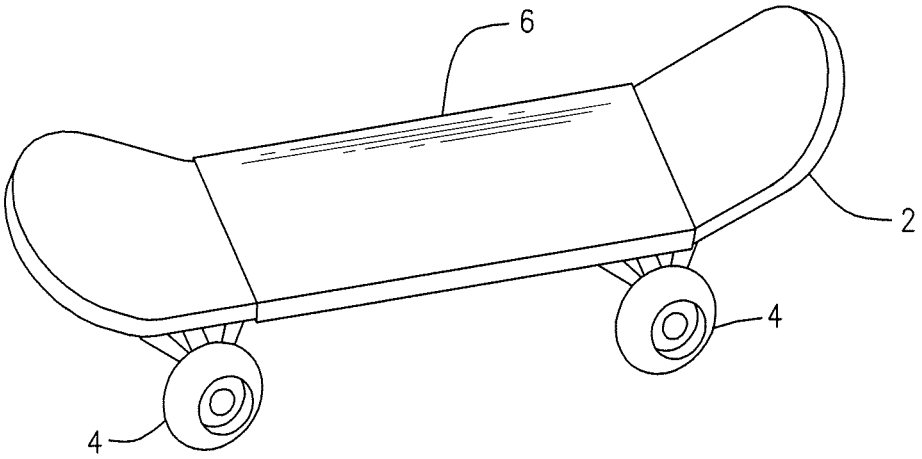
FIGS. 1*a* and 1*b* show an embodiment of the top and underside view of the cover on a skateboard.
Figure 1B:
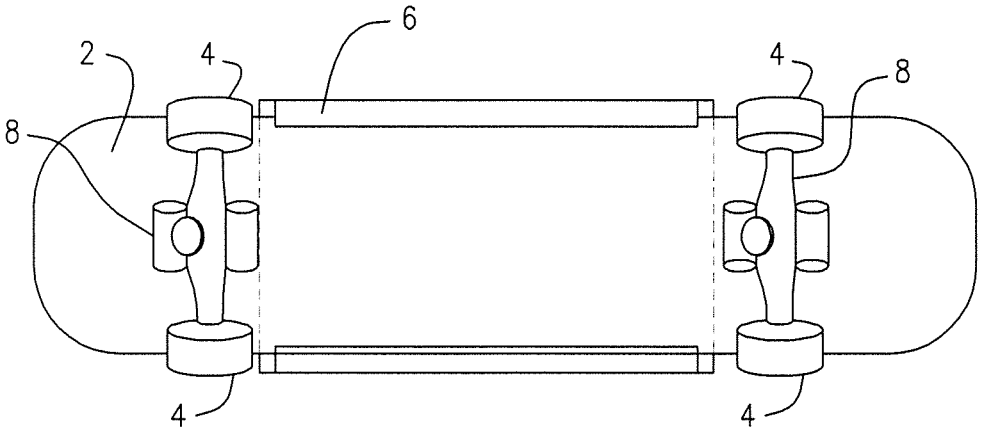

FIGS. 1A and 1B show the top and underside of a skateboard, respectively. A skateboard includes: a deck 2, four wheels 4, and two trucks 8 (a front and a rear). The present invention, cover 6, is shown on the top surface of deck 2 and reaches around to a portion of the bottom surface of deck 2.

Figure 2A:
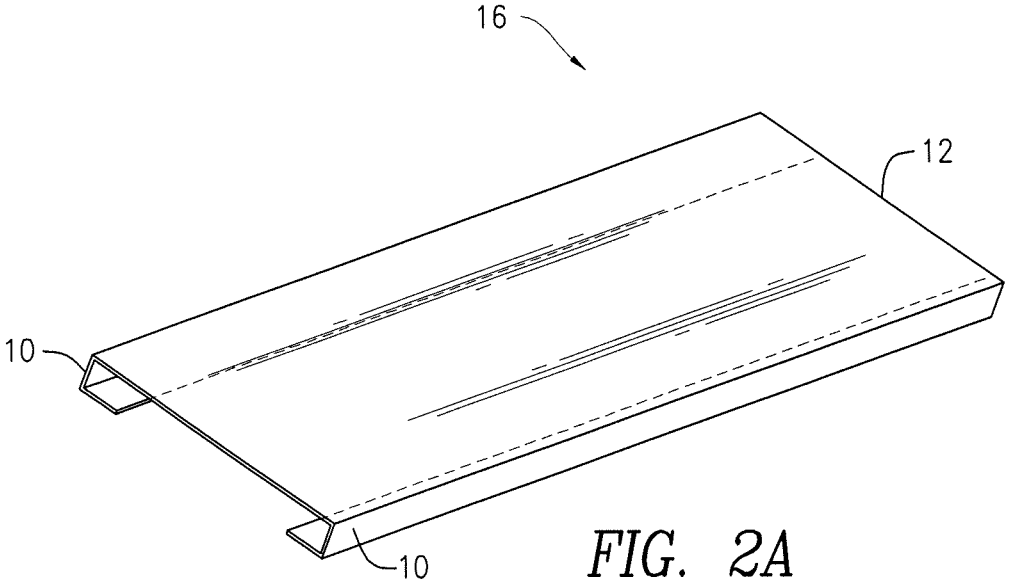
FIGS. 2*a* and 2*b* show an embodiment of the skateboard cover.
Figure 2B:
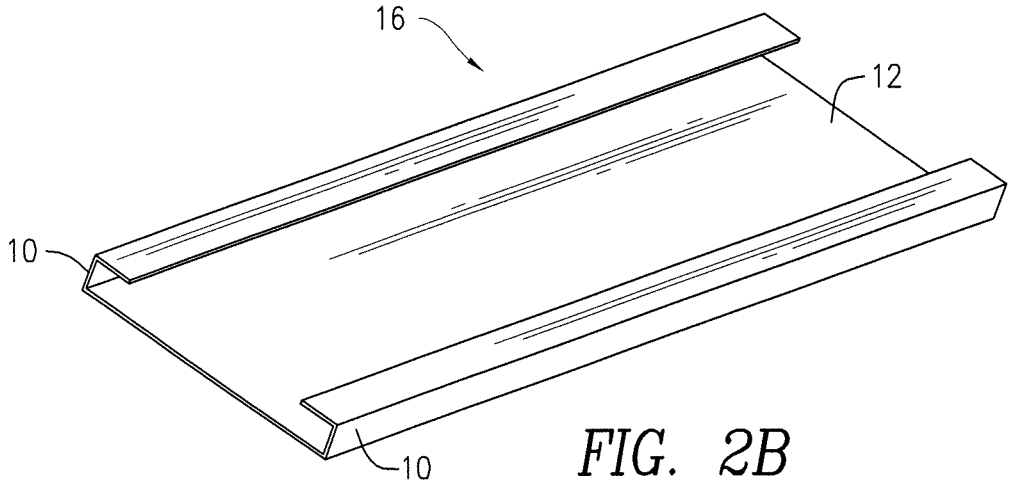

FIGS. 2A and 2B show one embodiment of the invention having a one-piece cover 16. Cover 16 consists of three attached components—top cover piece 12 and two side pieces 10. Top cover piece 12 is shorter in width than the board itself. Top cover 12 is stretchable and applied to the top surface of the middle portion of the deck. Top cover piece 12 may be proximal to the front and rear trucks, or extend further on the board, past the trucks, for example. Top cover piece 12 reaches from a first side of the board across the deck of the board to a second side of the board. Side pieces 10 are non-elastic rigid or semi rigid structures that run the length of cover 16 from the front of the deck to the back of the deck and are affixed to the left and right sides of top cover piece 12. Side pieces 10 each have three sides longitudinally and can be made of one solid piece or multiple attached segments to form one side piece. These three sides are at relative right angles to one another, similar to a rectangle, leaving a fourth side open and facing the left or right side of the board deck. The open sides of side pieces 10 allow side pieces 10 to surround the top and bottom of the deck and connect with top piece 12. Side pieces 10 are affixed on both sides of the board deck as a "[" or u-shaped longitudinal rigid or semi-rigid component that extend from the front of the board to the rear of the board, running the length of top piece 12.

Cover 16 is attached to the board by placing top cover piece 12 at the desired location on the top of the board deck. A first side piece 10 component is placed on one side of the board. Stretchable top cover piece 12 is then stretched to the opposite side of the deck and the second side piece 10 is applied, snapped on for example, to the other side of the deck board. The memory in the top cover 12 component applies a force on both the first and second side pieces 10 which are resisted by the three-sided constructs. Cover 16 is securely fixed to the skateboard.

The stretchable material of top cover 12 can be a plastic or elastic material such as rubber, for example. The side components 10 material can be any rigid or semi-rigid material.

Figure 3A:
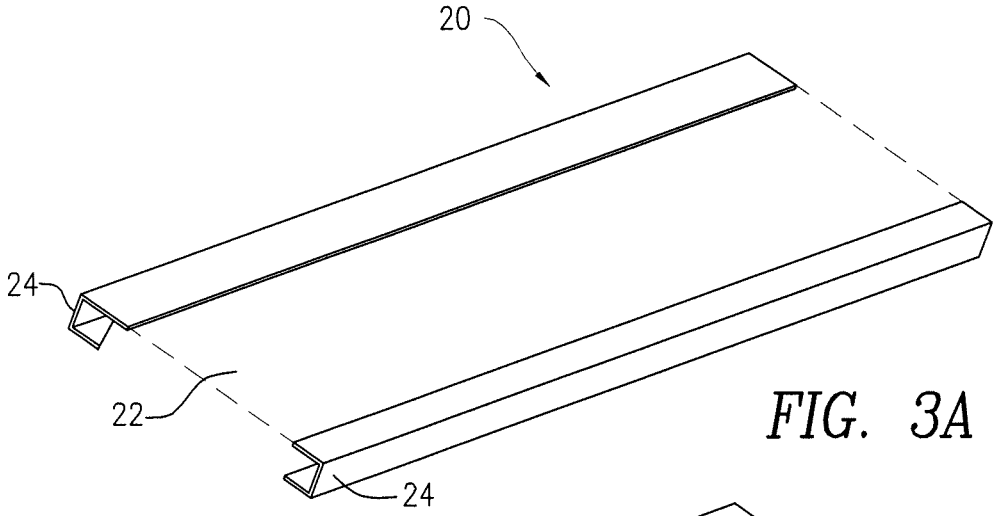
FIGS. 3*a*, 3*b* and 3*c* show another embodiment of the skateboard cover.
Figure 3B:
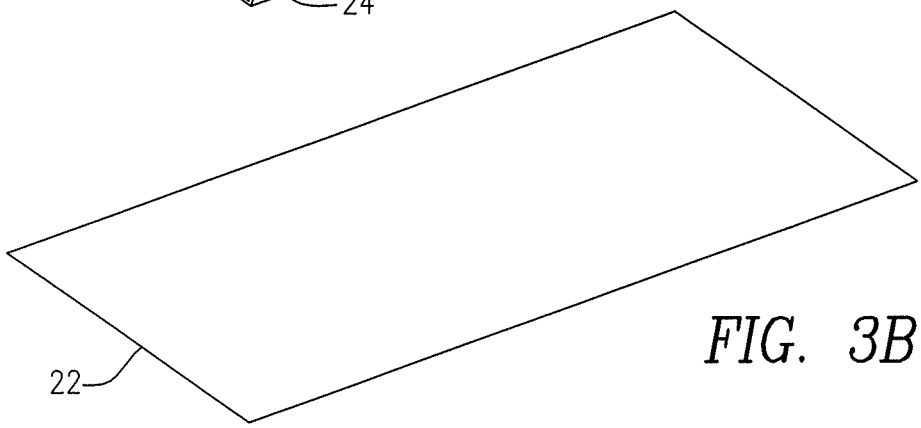
Figure 3C:
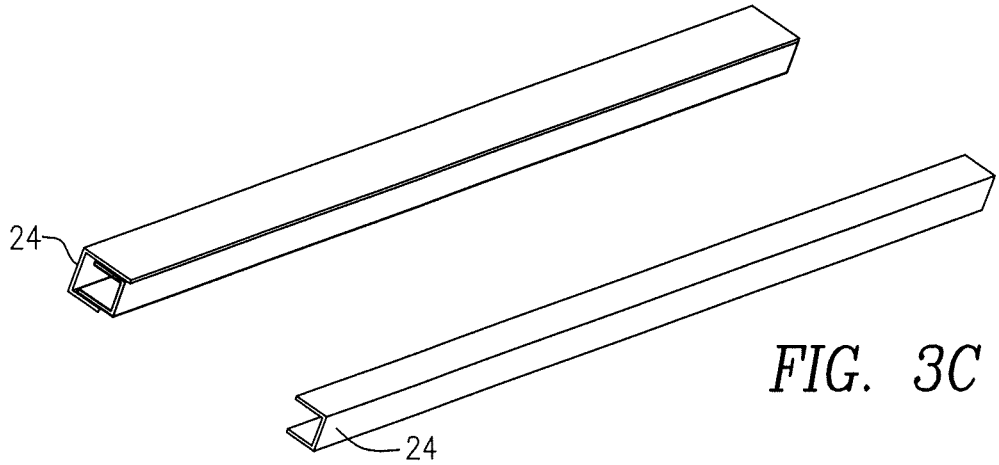

FIGS. 3*a*, 3*b* and 3*c* show a second embodiment of the invention that provides a skateboard cover 20 having three separate components—top cover 22 and individual side components 24. Top cover 22 may be any material and used to cover any desired surface of the board deck. Side components 24 can be any rigid or semi-rigid materials. Side components 24 are three sided longitudinal pieces and can be made of one solid piece or multiple attached segments to form one side piece. The three sides are at right angles to one another with an open side. The open side of the rectangle having a width slightly larger than the thickness of the board. Side components 24 are affixed on both sides of the deck of the board in a "[" or u-shape and extend from the front of the board to the rear side of the board, having the same length as top cover 22. Once top cover 22 is placed on the top of the deck of the board, side components 24 can be applied on opposite sides of the deck surrounding the side of the deck of the board and a portion of top cover 22 on each side. Side components 24 keep top cover 22 securely in place.

Figure 4A:
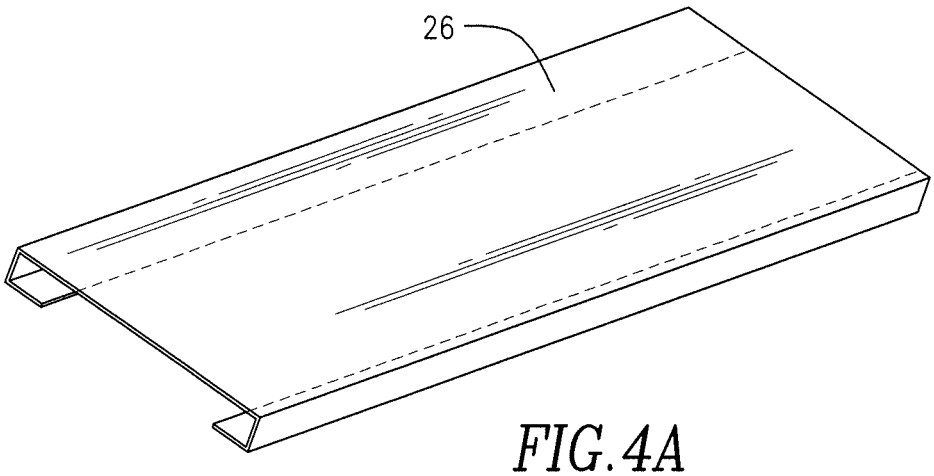
FIGS. 4*a* and 4*b* show an embodiment of the skateboard cover fastened using grommets.
Figure 4B:
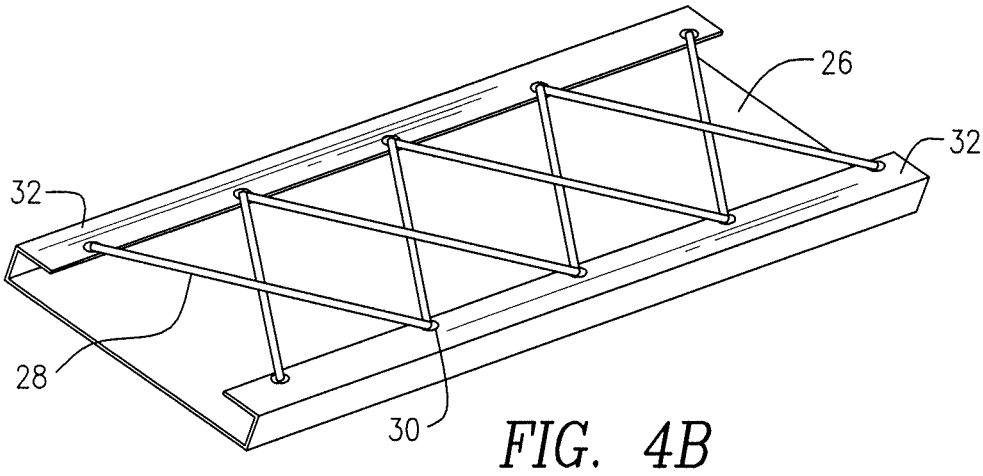

Another embodiment of the present invention provides different types of fixation of the cover to the board. For example, FIGS. 4*a* and 4*b* show grommets 30 are located throughout the under portion of side components 32. The number of grommets and the spacing of each may vary. "Laces" 28 go through grommets 30. The opposite sides could then be tightened in a shoelace manner, for example. Laces 28 can be made of any material. Grommets 30 can be replaced with hooks or used in conjunction with. These types of fixation can be used as an embodiment on their own or used in conjunction with the one or 3 piece embodiments disclosed above to provide additional tightening support for the cover.

The skateboard covers of the present invention can be removable and interchangeable with other size boards. An additional material or strips of material can be affixed in the top cover piece, for example sewn in. This additional top material provides additional stretch capabilities that allow the cover to expand to accommodate multiple board sizes without needing a new skateboard cover. The additional stretching material provides the additional stretch necessary for the cover to affix to a wider or longer board. The dimensions of the skateboard covers can be made in varying lengths and widths. The top surface of the top cover may or may not have a grip added, such as grip tape, depending on the user's preference. The present invention can be used on boards other then a skateboard. Such boards include scooters, snowboards, sandboards, and wakeboards, for example.

Although the present invention has been described in conjunction with specific embodiments, those of ordinary skill in the art will appreciate the modifications and variations that can be made without departing from the scope and the spirit of the present invention.

The invention claimed is:

1. A removeable cover securely affixed to a board comprising, a stretchable top piece, a first side piece and a second side piece, wherein said first and second side pieces are rigid or semi-rigid, and further comprising grommets and a lacing material, wherein the grommets are located on an underside of the first side piece and the second side piece, the lacing material running through the grommets, whereby tightening the lacing material ensures that the removeable cover is securely affixed to the board.

2. A removeable cover capable of being securely affixed to a top side of a skateboard, the skateboard having a predetermined length and width, comprising, a stretchable top piece having a predetermined elastic modulus and an unstretched width less than the width of the skateboard, a first side piece attached to a first side of the stretchable top piece, a second side piece connected to second side of the stretchable top piece, and whereby the first side piece is connected to a first side of the skateboard and the second side piece is connected to a second side of the skateboard by stretching the stretchable top piece and whereby the stretchable top piece has an elastic modulus sufficient to ensure that the removable cover is securely affixed to the topside of the skateboard.

3. A removeable cover capable of being securely affixed to a top side of a skateboard, the skateboard having a predetermined thickness and length, comprising, a solid top piece having a predetermined thickness, a first three-sided piece, said three sides being at right angles to each other and having an open fourth side with an opening of a predetermined height, a second three-sided side piece, said three sides being at right angles to each other and having an open fourth side with an opening equal to said predetermined height, whereby the height of each opening is equal to or slightly less than the thickness of the skateboard plus the thickness of the solid top piece so that sliding the opening in each side piece over a side of the solid top piece and a side of the skateboard will securely affix the removeable cover to the skateboard.

4. A removeable cover capable of being securely affixed to a top side of a skateboard, comprising a top piece, a first side piece and a second side piece, each side piece having a top portion, a bottom portion and an opening that fits over each side of the skateboard to cover a portion of the top portion when the top piece is placed on the skateboard, said bottom portion having grommets in selected locations, whereby running lacing material through said grommets, and tightening said lacing material securely affixes said removeable cover to said skateboard.

* * * * *